United States Patent [19]

Burdick et al.

[11] Patent Number: 4,741,113

[45] Date of Patent: May 3, 1988

[54] AIR WIPER

[75] Inventors: Fred Burdick, Noank; John R. Wheeler, Jr., Mystic, both of Conn.

[73] Assignee: Crompton & Knowles Corporation, New York, N.Y.

[21] Appl. No.: 941,055

[22] Filed: Dec. 12, 1986

[51] Int. Cl.[4] ..... F26B 13/28

[52] U.S. Cl. ..... 34/92; 34/155; 15/306 A; 15/316 R; 15/DIG. 7

[58] Field of Search ..... 34/155, 156, 23, 92; 15/306 A, 316 R, DIG. 7

[56] References Cited

U.S. PATENT DOCUMENTS

| | | | |
|---|---|---|---|
| 2,194,565 | 3/1940 | Moss | 34/23 |
| 3,633,256 | 1/1972 | Mallonee | 34/155 |
| 3,736,174 | 5/1973 | Moyer | 34/155 |

*Primary Examiner*—Larry I. Schwartz

[57] ABSTRACT

Apparatus for drying or removing adhering substances from the surface of a continuous advancing strand or other substantially non-adsorptive material moving at high speeds which enables the wire to be ink-printed immediately. The air wiper utilizes a compressed-air source to dry the wire, as well as a single vacuum pump for exhaust. Cone deflectors direct the wet air away from the wire and toward the vacuum chamber drainage.

4 Claims, 4 Drawing Sheets

AIR WIPER

THE BACKGROUND OF THE INVENTION

The invention relates generally to an apparatus for drying or removing adhering substances from the surface of a wet continuous strand or other non-absorptive material which is advanced along its longitudinal axis. The subject air wiper is designed to dry wire moving at high speeds so that the wire can be ink-printed immediately after drying. One or more air wipers treat the wire as it moves. Each air wiper utilizes the same compressed-air source to dry the wire as well as a single vacuum pump for exhaust. Cone deflectors direct the wet air away from the wire and toward the vacuum chamber.

Prior art air wipers (U.S. Pat. No. 4,159,579 to Hoddinott) are not capable of removing all of the cooling water from the insulated wire traveling at speeds of over 1000 meters per minute (MPM). These air wipers are limited by their ability and means to handle the removal of the water on the wire and yet keep the line speed moving quickly. Additionally, previously employed commerical air wipers that have employed various types of compressed air or vacuum systems have failed to accommodate the proportional increases in line speeds with the resulting increases in accumulated water. The principle of prior art air wipers employing either compress air jets or devices which pass the wire through air-evacuated by high volume vacuum air blowers resulted in failure to remove an adequate amount of water.

U.S. Pat. No. 4,361,466 to Wong et al disclosures a web drying method and apparatus having a supply of heated air and suction pumps for drying a web in a paper making machine. This invention outlines a dewatering and partial drying system in a paper making machine. A vacuum is used only in relation to holding the web as it allows hot air to be blown over the surface.

U.S. Pat. No. 2,194,565 to Moss is a typical compressed air wiper. It is similar to many on the market and stripes the water on the wire at low speeds only. At high speeds the unit is overwhelmed and the wire leaving the wiper is still wet and unusable.

U.S. Pat. No. 3,667,132 to Herbert again shows a web drier that provides air under pressure to a moving web. Exhaust means have the capacity to remove relatively greater amounts of air than is supplied by the air supply pump. This invention basically is a heating and drying apparatus for printing ink with a web process and is another illustration of the prior art status.

SUMMARY OF THE INVENTION

In general, the invention consists of apparatus for drying a continuous strand material such as insulated electrical wire, which is drawn along its longitudinal axis. The apparatus uses pressurized air to remove and carry away surface water from the wire as it passes through the assembly from the previous cooling process. The drying can be done in one or more sections for increased efficiency, each section consisting of a split pressurized air wipe assembly with one or more channels each designed to carry the water away from the surface of the wire by directing the pressurized air against and away from the travel direction of the wire. The resulting moisture and moisture laddened air is blown back against a cone deflector, which deflects and further forces the water and moisture filled air from the wire. Furthermore, the cone deflector prevents the wet air from blowing back onto the wire since these cones are in a high velocity vacuum suction chamber which enables the further withdrawal of the moisture and water from the wire to a resulting drainage.

The above procedure can be immediately repeated in exactly the same way if initial removal of the mass of surface water results in the need for additional removal of any residual moisture on the wire surface. The one or more air wiper assemblies, both cone deflectors and the common vacuum suction chamber are all housed in a common enclosure.

The principle of blowing and carrying away from the wire the water instead of blowing it back onto the wire, which is reflective of the prior art, and in addition the novel approach of having the water blown back against a cone defector which is under a high volume vacuum suction for elliminating the moisture, is unique within the art.

DESCRIPTION OF THE PREFERRED EMBODIMENT

Figure 3:
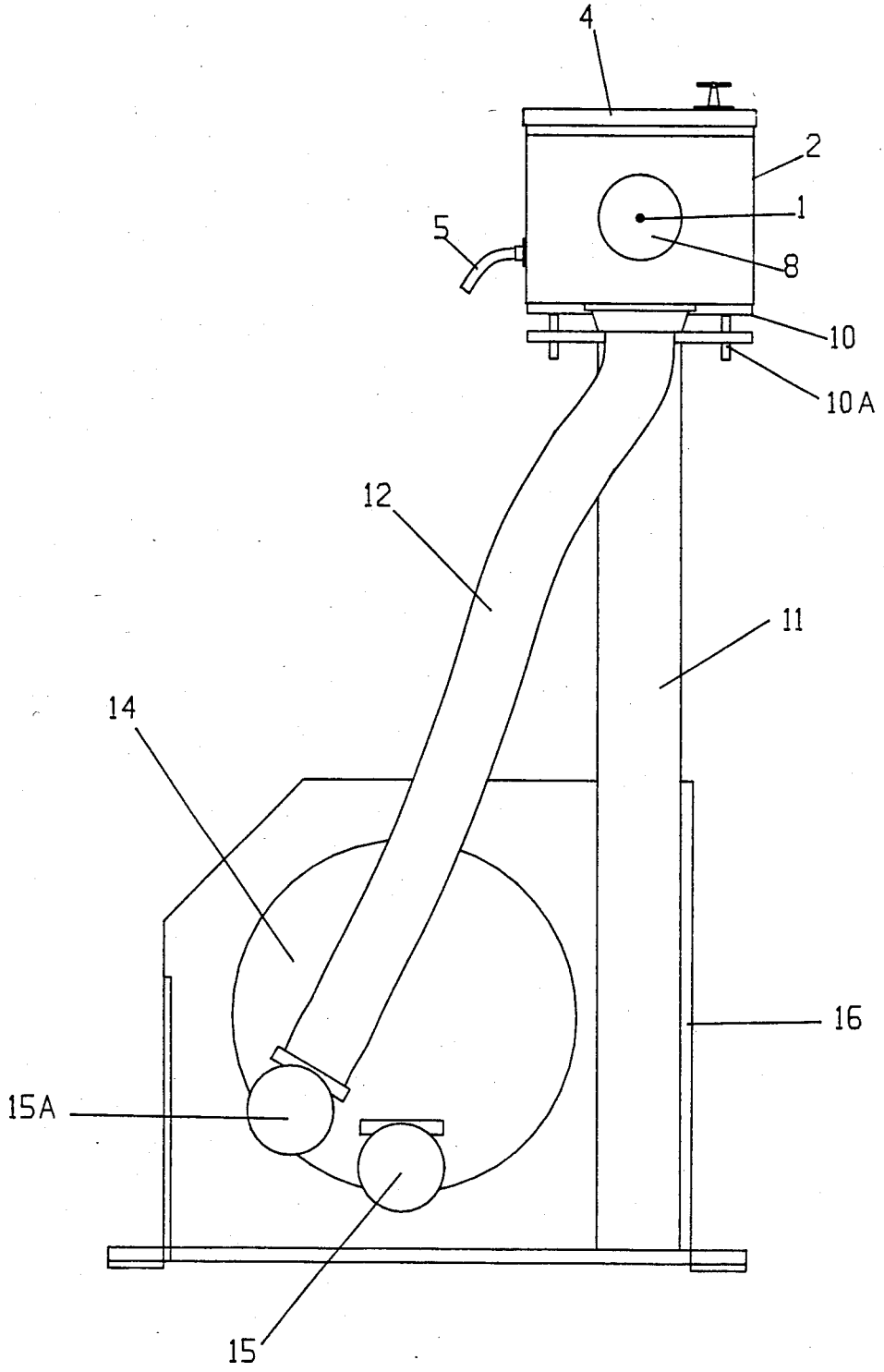
FIG. 3 is an end elevational view of a wiper with the strand traveling away from the viewer.
Figure 4:
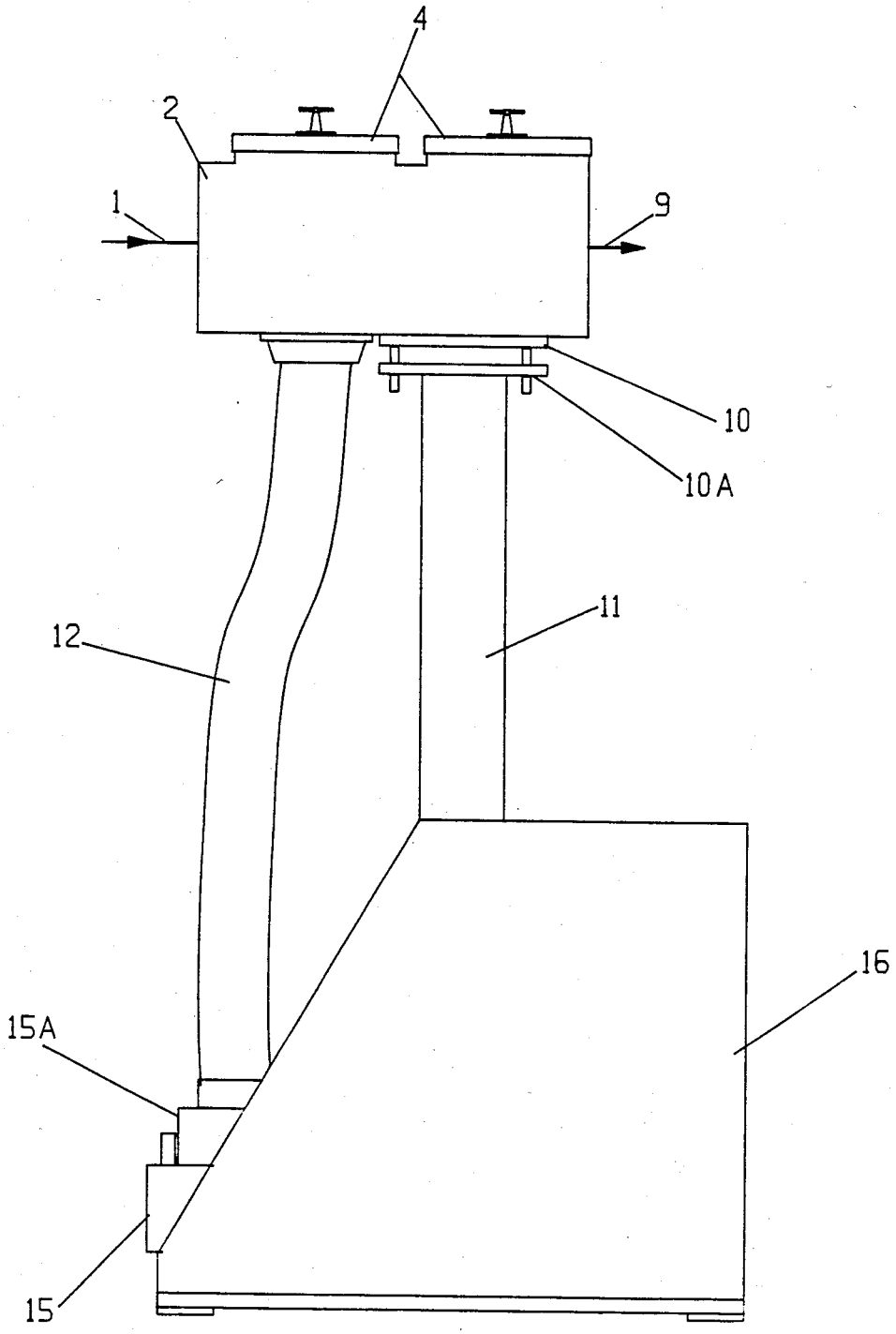
FIG. 4 is a front elevational view of a wiper.

Referring first to FIGS. 3 and 4, the invention is shown applied to a system for insulating electrical wire. This system includes an air wiper enclosure housing 2, a cover for the housing 4, reinforcing mounting plate 10 to protect the housing 2, a support column 11 for the housing 2, and a floor base 16 to support all components.

Figure 1:
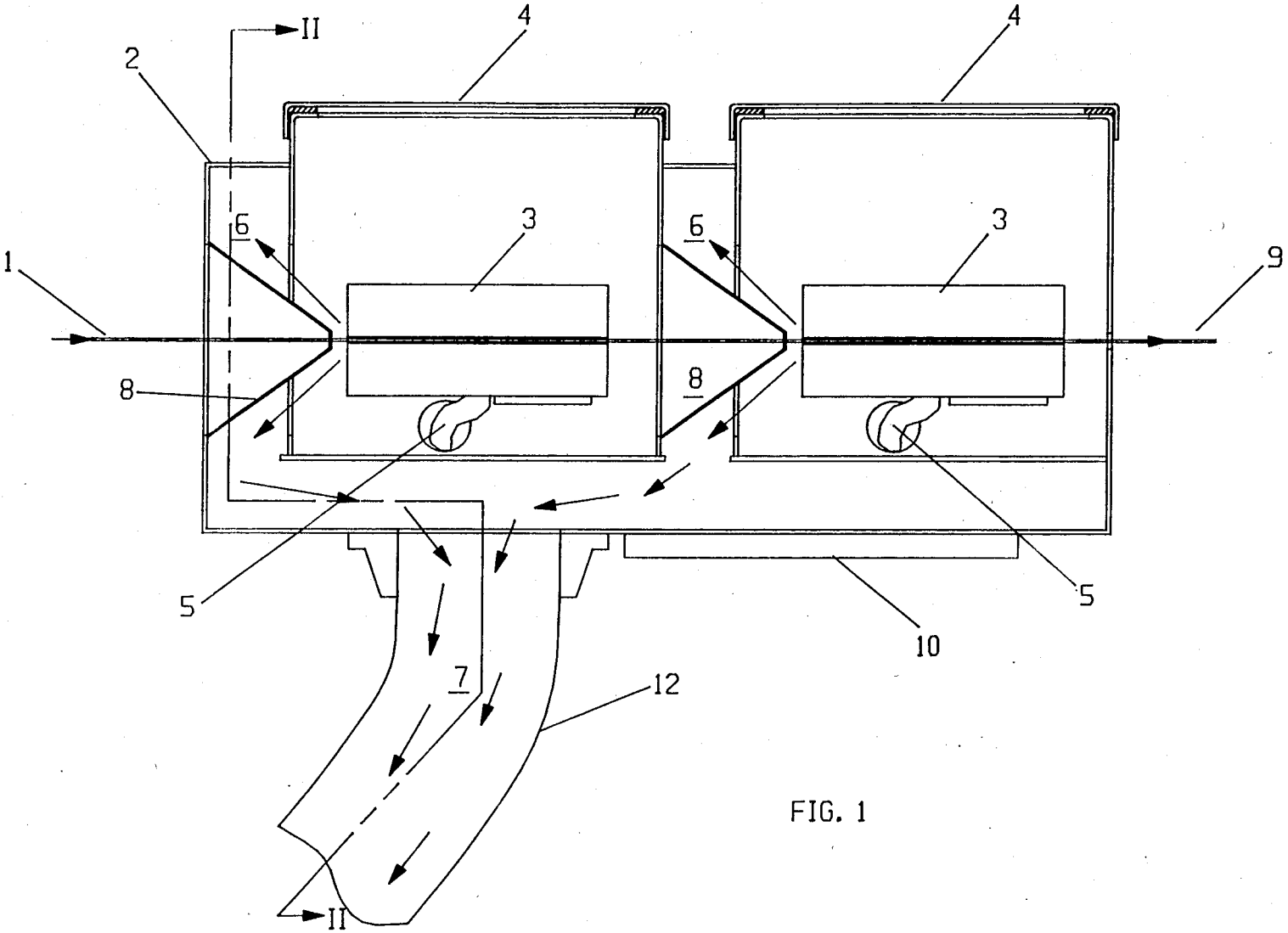
FIG. 1 is a cross sectional view taken along the lines I—I in FIG. 2 looking in the direction of the arrows.
Figure 2:
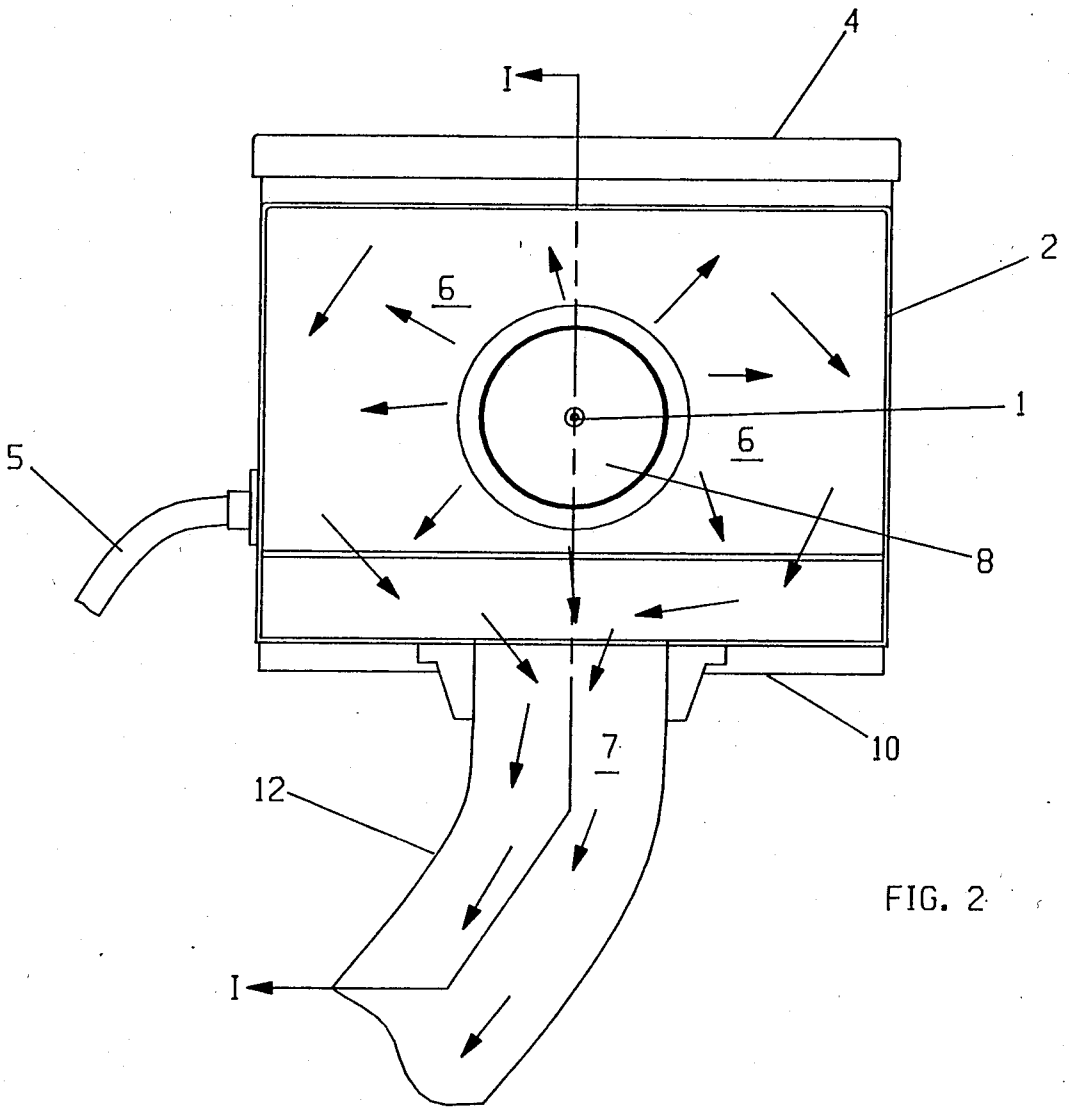
FIG. 2 is a cross sectional view taken along the lines II—II in FIG. 1 looking in the direction of the arrows.

Referring to FIGS. 1 and 2, the wire 1, enters the housing 2 through the cone 8 and into a commerically available compress air unit 3 which is supplied with compressed air through line 5, the wire being centered through the air wiper by an adjusting mechanism 10*a* (Shown in FIG. 3 and FIG. 4). As the wire 1 passes through the air unit 3, water and moist air are blown from the wire 1 and then deflected 6 off the cone 8. The deflected water 6 and moist air 7 run through hose 12 towards a vacuum blower 14. This water and moist air run through the inlet to the blower 15*a*, and exit through the exhaust of the blower 15 allowing a dry wire to emerge from the system 9.

As illustrated in FIG. 1, if residual moisture remains on wire 1, the wire 1 can be exposed to an additional cone 8 which will again initiate the above procedure.

We claim:

1. Apparatus for drying or removing adhering substances from the surface of a continuous strand or other substantially non-adsorptive material which is being advanced along its longitudinal axis comprising:

(a) at least one or more pressurized air assemblies applying compressed air against and away from a strand and the strand's direction of travel;

(b) in a high velocity vacuum suction chamber at least one or more cone deflectors located in the path of the pressurized air and surrounding the strand;

(c) means to supply compress air to the air assemblies, and (d) pressurized air passing along the external surface of the cone with means to draw and exhaust wet air and moisture away from the deflector to a drainage.

2. Apparatus as recited in claim 1, wherein the cone deflector is stainless steel.

3. Apparatus as recited in claim 1, wherein each cone deflector is structured prior to the placement of the each air assembly.

4. Apparatus as recited is claim 1, wherein an exhaust fan is used to draw off the excess moisture.

* * * * *